US005402929A

United States Patent [19]

Ritter et al.

[11] Patent Number: 5,402,929

[45] Date of Patent: Apr. 4, 1995

[54] CONTAINER TRAY-COVER CORNER CLOSURE ARRANGEMENT

[75] Inventors: Karl M. Ritter, Wheaton; Noel J. Mertz, Geneva, both of Ill.

[73] Assignee: Jefferson Smurfit Corporation, Clayton, Mo.

[21] Appl. No.: 293,149

[22] Filed: Aug. 19, 1994

[51] Int. Cl.[6] ..... B65D 5/24

[52] U.S. Cl. ..... 229/110; 229/149; 229/150; 229/186; 229/906

[58] Field of Search ..... 229/109, 110, 149, 150, 229/186, 902, 906

[56] References Cited

U.S. PATENT DOCUMENTS

| | | | |
|---|---|---|---|
| 2,973,858 | 3/1961 | Laneve et al. | 229/149 |
| 3,462,065 | 8/1969 | Asman | 229/109 |
| 3,512,697 | 5/1970 | Robinson | 229/109 |
| 3,923,234 | 12/1975 | Lund, Jr. | 229/109 |
| 4,747,485 | 5/1988 | Chaussadas | 229/109 |
| 4,765,534 | 8/1988 | Zion et al. | 229/149 |
| 4,919,326 | 4/1990 | Deiger | 229/109 |
| 5,110,039 | 5/1992 | Phillips | 229/110 |
| 5,211,329 | 5/1993 | Patton | 229/110 |
| 5,263,634 | 11/1993 | Korine | 229/109 |

FOREIGN PATENT DOCUMENTS

| | | | |
|---|---|---|---|
| 2116150 | 9/1980 | United Kingdom | 229/109 |

*Primary Examiner*—Gary E. Elkins
*Attorney, Agent, or Firm*—Richard W. Carpenter

[57] ABSTRACT

A tray-cover, corner closure arrangement for a hexagonal, one-piece, collapsible, tray-type, paperboard container with diagonal front corners. The container includes a tray, with front end and tray side wall panels interconnected by a four section gusset, and a cover hinged to the tray and including a pair of corner lock tabs adapted to be inserted between the tray corner gussets and the tray bottom wall panel.

20 Claims, 2 Drawing Sheets

19
18
12
15
14
20
33
32
21
38
35
37a
33a
36
37c
37b
34

32
33a
37c
42
44
12
38
14
20

42
13a
12
13
13b 42
23
44
32
23
20
38

42
44
18
32
23
38

42
9
44
32
20
9
38

CONTAINER TRAY-COVER CORNER CLOSURE ARRANGEMENT

BACKGROUND OF THE INVENTION

1. Field of the Invention

This invention relates to tray type containers with hinged covers, of the type commonly used for the packaging of pizzas and similar carry out food products, and, more particularly, to an improved container tray-cover corner closure arrangement.

2. Description of the Background Art

A background art search directed to the subject matter of this invention conducted in the United States Patent and Trademark Office disclosed the following United States Letters Patent:

| | | | |
|---|---|---|---|
| 2,707,586 | 4,265,393 | 4,765,534 | 4,919,326 |
| 5,000,374 | 5,110,039 | 5,211,329 | |

None of the patents uncovered in the search discloses a one-piece, collapsible, tray-type, paperboard container, with diagonal corners, that includes a tray having a front end wall panel and a pair of side wall panels interconnected at each tray front corner by a four-section gusset having first and second sections, foldably joined to the front end and side wall panels, a third section interconnecting the first and second sections, and a fourth section, connecting the first section to a bottom wall panel, and which container also includes a cover hinged to the tray and having a pair of corner lock tabs each of which are adapted to be inserted between the tray bottom wall panel and a related tray gusset first section adjacent the related tray gusset fourth section.

SUMMARY OF THE INVENTION

It is a primary object of the invention to provide an improved corner closure arrangement for a collapsible, one-piece, tray type, paperboard container with hinged cover.

Another object of the invention is the provision of a container of the type described having diagonally extending front corners that can be easily and quickly erected manually.

A more specific object of the invention is to provide a container, tray-cover, corner closure arrangement wherein the tray front end and tray side wall panels are interconnected at each front corner of the tray by a four section gusset, and a cover hinged to the tray and including a pair of corner lock tabs adapted to be inserted between the tray corner gussets and the tray bottom wall panel.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

The present invention represents an improvement over the tray corner and cover closure flap arrangements disclosed in co-pending applications of the Applicants, Karl M. Ritter, Ser. No. 08/167,214, Filed Dec. 16, 1993, and Noel J. Mertz, Ser. No. 08/186,859, Filed Jan. 27, 1994.

Figure 1:
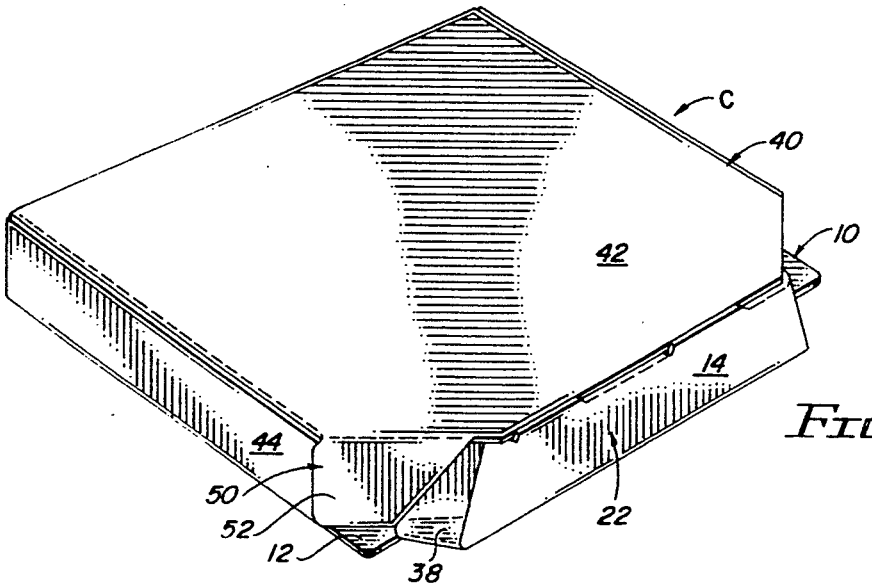
FIG. 1 is an isometric view of a container with a tray-cover corner closure arrangement embodying features of the invention.
Figure 2:
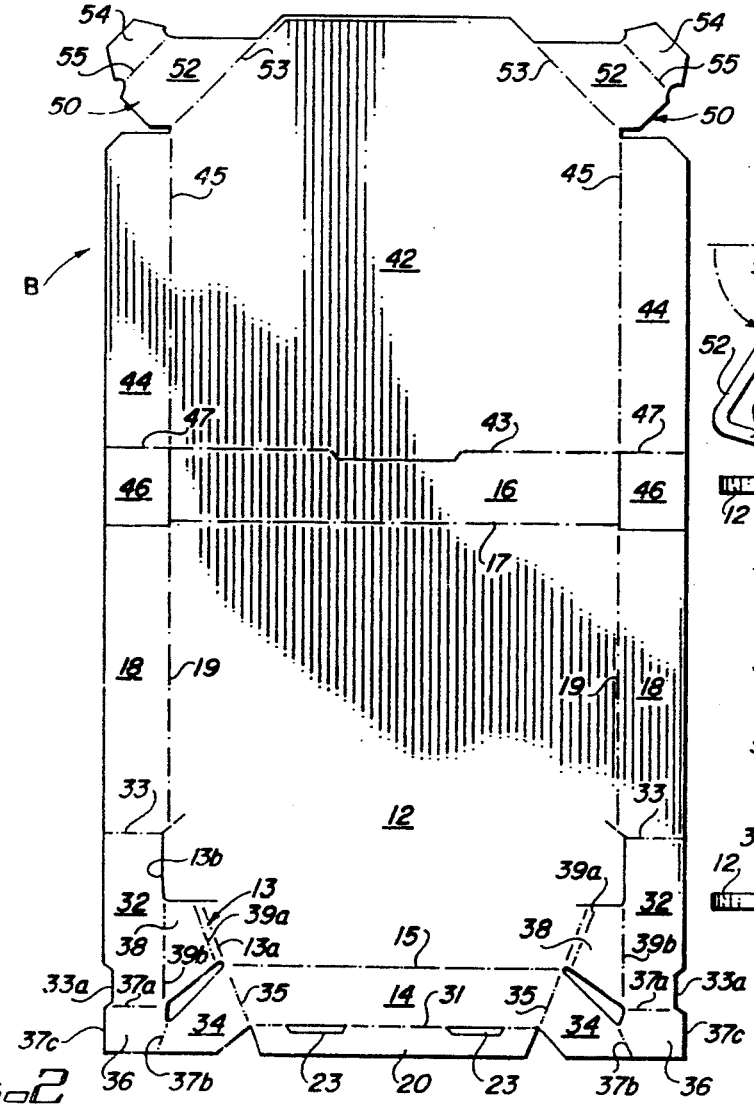
FIG. 2 is a plan view of the blank of sheet material used to form the container illustrated in the other views.
Figure 9:
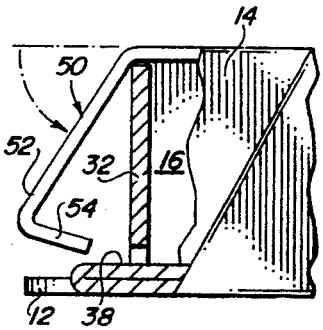
FIGS. 9 and 10 are partial vertical sectional views taken on line 9—9 of FIG. 8, showing the cover container closure flap before and after it has been completely inserted into the container tray.
Figure 10:
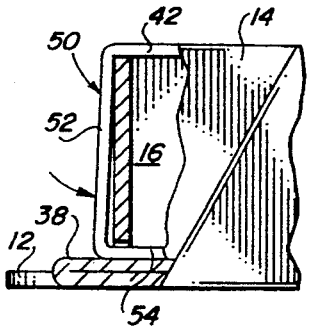

Referring now to the drawings for a better understanding of the invention, it will be seen that the tray type container, embodying features of the invention and indicated generally at C in FIG. 1, may be formed from the unitary blank of foldable paperboard indicated generally at B in FIG. 2.

As best seen in FIG. 2, the tray, indicated generally at 10 includes a hexagonal bottom wall panel 12 with a front wall panel 14 and a rear end wall panel 16 foldably joined to front and rear edges along fold lines 15 and 17, respectively; and a pair of side wall panels 18, foldably joined to opposed side edges thereof along fold lines 19. Bottom wall panel 12 has a pair of truncated front corners defined by corner edges 13. Each corner edge 13 has a rear L-shaped portion **13*a* and a front diagonal portion 13*b***.

A retaining flap 20 is foldably joined to the upper edge of front end wall panel 14, along fold line 21, to form an L-shaped front end wall 22. Again referring to FIG. 2, it will be seen that portions of retaining flap 20 are cut out to provide a pair of lock tab receiving openings 23, located adjacent fold line 21.

Figures 3, 4, 5, 6, 7, 8:
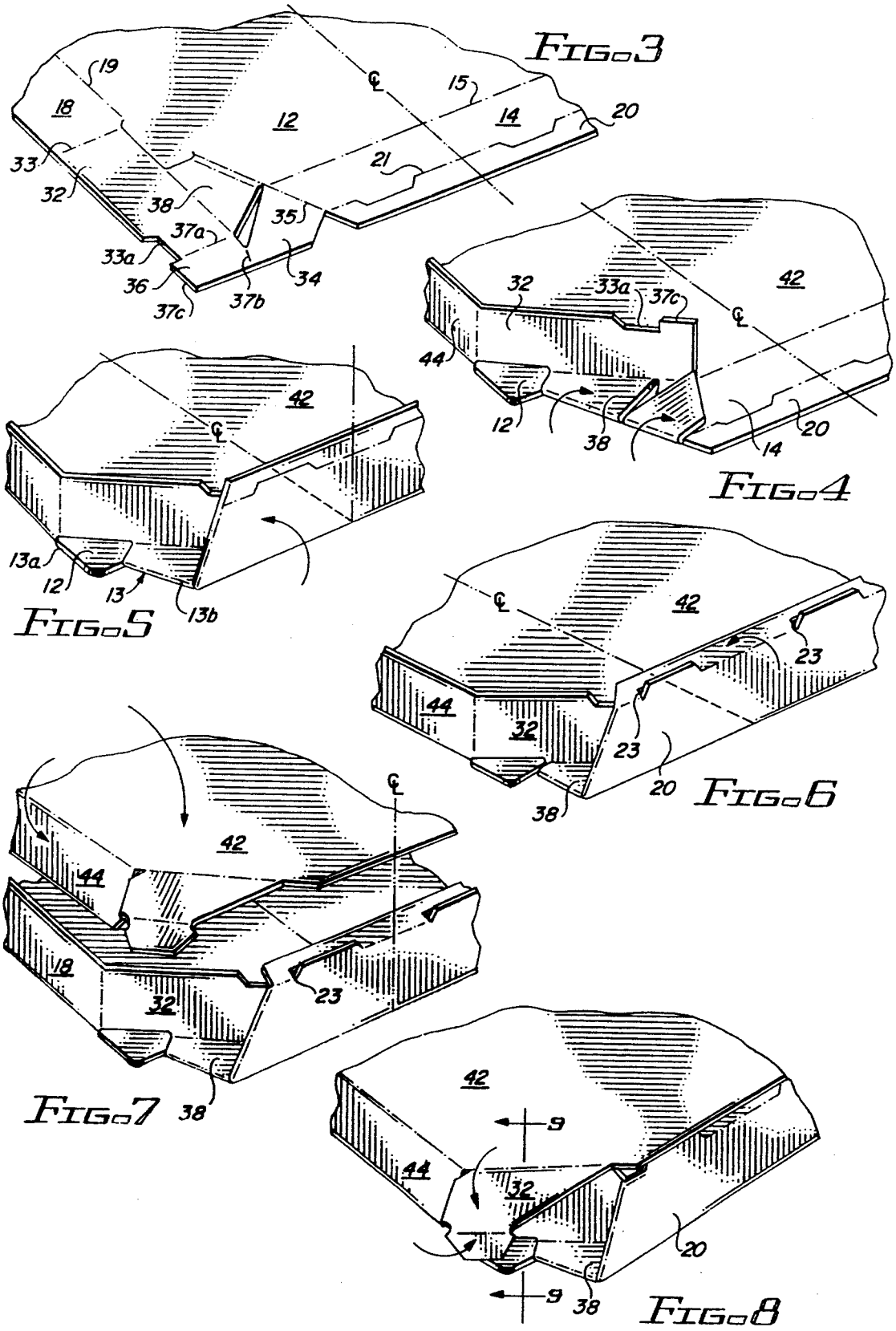
FIG. 3 is an isometric view of a portion of the structure shown in FIG. 2.
FIGS. 5–8 are partial isometric views illustrating the stepf of erecting, closing, and locking closed the tray and cover of the container shown in FIG. 1.

As best seen in FIGS. 2 and 3, the front end edges of tray side wall panels 18 are spaced from the adjacent side edges of front wall end panel 14, but are connected thereto at the tray front corners by four-section gussets, indicated generally at 30.

Each gusset 30 includes a first or side section 32, foldably joined along a fold line 33 to a front edge of a related tray side wall panel 18; a second or front section 34, foldably joined along a fold line 35, to an adjacent side edge of tray front end wall panel 14; a third or corner section 36, foldably joined along a fold line **37*a* to first section 32, and foldably joined along a fold line 37*b* to second section 34; and a fourth or reinforcing section 38, foldably joined along a fold line 39*a* to a related bottom wall panel corner edge diagonal portion 13*b*, and foldably joined along a fold line 39*b* to a lower edge of gusset first section 32**.

Each gusset third section may be provided, at its upper edge, with a projection **37*c* that serves as a lock tab, receivable within opening 23 in the tray front wall retaining flap 20, to provide an interlocking connection, through the gusset 30**, between the tray side wall panel and the front end wall, as hereinafter described.

In the present invention, tray 10 is provided with a hinged cover, indicated generally at 40, which includes a pair of corner closure flaps 50 adapted to cooperate and interlock with the novel corner portions of the tray, as hereinafter described.

As seen in FIGS. 2 and 3, cover 40 includes a hexagonal top wall panel 42, foldably joined along fold line 43 to the upper edge of tray rear end wall panel 16; and a pair of depending side wall panels 44, foldably joined along fold lines 45 to opposed side edges of top wall panel 42.

Cover 40 includes a pair of locking flaps 50, having main portions 52, foldably joined, on fold lines 53 to diagonally extending front corner edges of cover top wall panel 42, and having tuck tab portions 54, foldably joined along fold lines 55 to lower edges of main portions 52.

Although the tray side wall panels may be connected to the tray rear end wall panel in different ways, in the invention of the present application the cover side wall panels 44 are shown as having rear corner flaps 46 foldably joined to their rear edges along fold lines 47. Corner flaps 46 may be folded inwardly against the inner surface of the tray rear end wall panel 16 when the container is erected In order to erect the tray, the front end wall panel 14 and the side wall panels 18 are folded upwardly from the bottom wall panel 12. At the same time gusset second and third sections 34 and 36 are folded inwardly until second section 34 lies against the inner or rear surface of front end wall panel 14, and third section 36 lies against portions of the inner or rear surfaces of both second section 34 and front wall panel 14.

At the same time gusset first and fourth sections 32 and 38, respectively, are folded inwardly, with the fourth sections overlying the upper surface of bottom wall panel 12, to position gusset first sections 32 inboardly of the tray bottom wall panel corner edges 14, and normal to the plane of the bottom wall panel.

Then the tray front end wall retaining flap 20 is folded inwardly 90 degrees with the gusset third section lock tabs being engaged in the respective front end wall recesses 23, and the ends of the retaining flap being received within the respective gusset first section recesses 33*a*. This arrangement provides for a rigid container corner construction that is easily and quickly erected.

In order to close the container cover, after the container has been filled, the tray rear wall end panel 16 is folded to the vertical position, with the cover rear corner flaps 46 being folded inwardly to lie against the inner surface of tray rear end wall panel 16.

The cover can then be locked to the tray by folding the locking flaps 50 downwardly and folding each tuck tab 54 portion inwardly and inserting it under the related gusset first section 32 in the space between the front edge of the related side wall panel 18 and the rear edge of the related gusset fourth section 38, which is immediately adjacent, to securely lock the cover in place over the tray.

What is claimed is:

1. An improved tray-cover corner closure arrangement for a one-piece, paperboard container, comprising:

(a) a tray including a bottom wall panel having a pair of parallel front and rear end edges, a pair of parallel side edges extending forwardly from opposite ends of said rear end edge, part way toward said front end edge, and corner edges extending between said side edges and said front edge, each of said corner edges having at least a portion thereof extending diagonally;

(b) said bottom wall panel having front and rear end wall panels extending upwardly from front and rear end edges thereof, and side wall panels extending upwardly from side edges thereof;

(c) said front end wall panel having a retaining flap foldably joined to an upper edge thereof and extending inwardly therefrom to form therewith an L-shaped front wall;

(d) each of said side wall panels being connected to said front end wall panel by a gusset, which includes:

(i) a first section having a first end edge, foldably joined to a front end edge of a related one of said side wall panels, and also having a second end edge;

(ii) a second section having a first end edge, foldably joined to a related side edge of said front end wall panel, and also having a second end edge;

(iii) a third section having adjacent side edges foldably joined to adjacent second end edges of respective first and second sections;

(iv) said first section being folded inwardly to extend over and in a plane normal to that of said bottom wall panel;

(v) a fourth section having an inboard edge foldably joined to a lower edge of said gusset first section and having an opposed outboard edge foldably joined to a related of said bottom wall panel corner edge diagonal portions;

(e) said second and third sections being folded to lie in face-to-face relation with each other against an adjacent inner surface of said front end wall panel;

(f) said fourth section being folded to lie on top of an upper surface of said bottom wall panel and thereby position said first section inboardly from a related of said bottom wall panel corner edges;

(g) said third section including a lock tab projecting upwardly from an upper edge thereof for engagement with a related opening in said front end wall to provide interlocking engagement between said third section and said front end wall panel;

(h) a cover including a top wall panel with a rear end edge foldably joined to an upper edge of said tray rear end wall panel, and having side edges connected to a front end edge thereof by diagonal corner edges;

(i) said cover also including corner closure flaps foldably joined to said cover top wall panel corner edges and each including a tuck tab adapted to be inserted between a related of said gusset first sections and said bottom wall panel at a location immediately adjacent a related of said gusset fourth sections.

2. An arrangement according to claim 1, wherein said tray bottom wall panel corner edge has another portion that is L-shaped.

3. An arrangement according to claim 1, wherein each of said gusset first sections have, in an upper edge thereof, a front wall retaining flap recess.

4. An arrangement according to claim 1, wherein each of said gusset second sections is pentagonal.

5. An arrangement according to claim 1, wherein each of said gusset fourth sections is quadrilateral.

6. An arrangement according to claim 1, wherein each of said gusset first sections has a lower edge spaced above an upper surface of said tray bottom wall panel, by a related of one said gusset fourth sections, to provide therebetween a space for receiving said cover closure flap tuck tabs.

7. An arrangement according to claim 1, wherein said cover includes a pair of side wall panels foldably joined to and depending from opposed side edges of said top wall panel, and a rear corner flap foldably joined to a rear edge of each of said cover side wall panels.

8. A blank according to claim 1, wherein said cover includes a pair of side wall panels foldably joined to opposed side edges of said top wall panel, and a rear corner flap foldably joined to a rear edge of each of said cover side Wall panels.

9. An improved tray-cover corner closure arrangement for a one-piece, paperboard container, comprising:

(a) a tray including a bottom wall panel having a pair of parallel front and rear end edges, a pair of parallel side edges extending forwardly from opposite ends of said rear end edge toward said front end edge, and at least one corner edge extending between one of said side edges and said front edge, said corner edge having at least a portion thereof extending diagonally;

(b) said bottom wall panel having front and rear end wall panels extending upwardly from front and rear end edges thereof, and side wall panels extending upwardly from side edges thereof;

(c) said front end wall panel having a retaining flap foldably joined to an upper edge thereof and extending inwardly therefrom to form therewith an L-shaped front wall;

(d) at least one of said side wall panels being connected to said front end wall panel by a gusset, which includes:

(i) a first section having a first end edge, foldably joined to a front end edge of said one side wall panel, and said first section also having a second end edge;

(ii) a second section having a first end edge, foldably joined to an adjacent side edge of said front end wall panel, and said second section also having a second end edge;

(iii) a third section having adjacent side edges foldably joined to adjacent second end edges of respective first and second sections;

(iv) said first section being folded inwardly to extend over and in a plane normal to that of said bottom wall panel;

(v) a fourth section having an inboard edge foldably joined to a lower edge of said first section and having an opposed outboard edge foldably joined to said bottom wall panel corner edge diagonal portion;

(e) said second and third sections being folded to lie in face-to-face relation with each other against an inner surface of said front end wall panel;

(f) said fourth section being folded to lie against an upper surface of said bottom wall panel and thereby position said gusset first section inboardly from said bottom wall panel corner edge;

(g) said third section including a lock tab projecting upwardly from an upper edge thereof for engagement with a related opening in said front end wall to provide interlocking engagement between said third section and said front end wall panel;

(h) a cover including a top wall panel with a rear end edge foldably joined to an upper edge of said tray rear end wall panel, and having at least one side edge connected to a front end edge thereof by a diagonal corner edge;

(i) said cover also including at least one corner closure flap foldably joined to said cover top wall panel corner edge and including a tuck tab adapted to be inserted between said gusset first section and said bottom wall panel at a location immediately adjacent said gusset fourth section.

10. An arrangement according to claim 9, wherein said tray bottom wall panel corner edge has another portion that is L-shaped.

11. An arrangement according to claim 9, wherein said gusset first section has, in an upper edge thereof, a front wall retaining flap recess.

12. An arrangement according to claim 9, wherein said gusset second section is pentagonal.

13. An arrangement according to claim 9, wherein said gusset fourth section is quadrilateral.

14. An arrangement according to claim 9, wherein said gusset first section has a lower edge spaced above an upper surface of said tray bottom wall panel, by said gusset fourth section, to provide therebetween a space for receiving said cover closure flap tuck tab.

15. A unitary blank of foldable paperboard which has been cut and scored to form improved tray-cover corner closure arrangement for a one-piece, paperboard container, comprising:

(a) a tray bottom wall panel having a pair of parallel front and rear end edges, a pair of parallel side edges extending forwardly from opposite ends of said rear end edge, part way toward said front end edge, and corner edges extending between said side edges and said front edge, each of said corner edges having at least a portion thereof extending diagonally;

(b) front and rear end wall panels having first side edges foldably joined to said bottom wall panel front and rear edges, and side wall panels having first side edges foldably joined to said bottom wall panel side edges;

(c) said front end wall panel having a retaining flap foldably joined to second side edge thereof opposite said first side edge (d) each of said side wall panels being connected to said front end wall panels by a multi-section gusset which includes:

(i) a first section having a first end edge, foldably joined to a front end edge of a related one of said side wall panels, and also having a second end edge;

(ii) a second section having a first end edge, foldably joined to a related side edge of said front end wall panel, and also having a second end edge;

(iii) a third section having adjacent side edges foldably joined to adjacent second end edges of respective first and second sections;

(iv) a gusset fourth section having an outboard edge foldably joined to an inboard edge of said first section and having an opposed inboard edge foldably joined to a related of said bottom wall panel corner edge diagonal portions;

(e) a cover top wall panel having a rear end edge foldably joined to a second side edge of said tray rear end wall panel, and having opposed side edges connected to a front edge by diagonally extending corner edges;

(f) corner closure flaps having first edges foldably joined to said cover top wall panel corner edges and having second edges foldably joined to tuck tabs adapted to be inserted between a related of said gusset first sections and said bottom wall panel at a location immediately adjacent a related of said gusset fourth sections when said container is erected.

16. A blank according to claim 15, wherein said tray bottom wall panel corner edge has another portion that is L-shaped.

17. A blank according to claim 15, wherein each of said gusset first sections have, in an outboard edge thereof, a front wall retaining flap recess.

18. A blank according to claim 15, wherein each of said gusset second sections is pentagonal.

19. A blank according to claim 15, wherein each of said gusset fourth sections is quadrilateral.

20. A blank according to claim 15, wherein said gusset second and fourth sections are spaced from each other to define an opening therebetween.

* * * * *